US007150599B2

(12) United States Patent
Ku et al.

(10) Patent No.: US 7,150,599 B2
(45) Date of Patent: Dec. 19, 2006

(54) FRAME STRUCTURE FOR FAN UNIT

(75) Inventors: Chin Long Ku, Tu-Chen (TW); Chin-Wen Yeh, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 138 days.

(21) Appl. No.: 10/946,726

(22) Filed: Sep. 21, 2004

(65) Prior Publication Data

US 2005/0186072 A1 Aug. 25, 2005

(30) Foreign Application Priority Data

Feb. 20, 2004 (CN) ..... 2004200428478

(51) Int. Cl.
*F04D 29/52* (2006.01)

(52) U.S. Cl. ..... 415/116; 415/221

(58) Field of Classification Search ..... 415/221, 415/116; 416/244 R; 361/695
See application file for complete search history.

(56) References Cited

U.S. PATENT DOCUMENTS 4,776,755 A * 10/1988 Bjorkestam et al. ..... 415/121.2
6,434,002 B1 * 8/2002 Wei ..... 361/697
6,746,205 B1 * 6/2004 Huang et al. ..... 415/116

* cited by examiner

*Primary Examiner*—Ninh H. Nguyen
(74) *Attorney, Agent, or Firm*—Wei Te Chung

(57) ABSTRACT

A fan frame (10) for encircling an impeller (20) of a fan unit is disclosed. The fan frame includes a base (11) and a plurality of sidewalls (12) extending from the base. The base defines a hole (13) in a center so that an airflow passage is formed between the impeller and the sidewalls. The sidewalls extend upwardly from side edges of the base for encircling the impeller. Each of the sidewalls is bent inwardly to form a bent portion (121) with a groove (14) formed between the bent portion and an adjacent sidewall for providing extra access to airflow through the passage.

17 Claims, 2 Drawing Sheets

FRAME STRUCTURE FOR FAN UNIT

BACKGROUND OF THE INVENTION

1. Field of the Invention

The present invention relates to a fan frame structure, and more particularly to a fan frame having a plurality of grooves for providing extra air entrances to increase the amount of air sucked into and through a fan unit thereof.

2. Description of Prior Art

Basically, a fan unit is utilized to promote air circulation for heat dissipation. The better the air circulation is, the more effective the heat dissipation is. FIG. 3 and FIG. 4 show a conventional axial-flow fan 100 for heat dissipation. The fan 100 includes a fan frame 101 and an impeller 102 encircled by the fan frame 101. An air passage 103 is formed between the impeller 102 and an inner periphery of the fan frame 101. The passage 103 defines an air inlet 104 and an opposite air outlet 105. The impeller 102 of the fan 100 is further connected with a motor 106 for providing forced airflow during operation.

The arrows shown in FIG. 2 represent the airflow passage produced by the fan 100. However, it is noticed that the disadvantage of this prior art fan 100 resides in that the source of air sucked into and through the fan 100 is restricted to only the axial airflow flowing from the top to the bottom through the air passage 103 and the amount of air through the fan 100 is limited subject to the narrowed air inlet 104. Thus the heat dissipation effect of the fan 100 is not satisfactory.

In order to increase the amount of air through a fan unit, measures such as increasing the rotation speed of the motor or enlarging the size of the air inlet are under consideration. But unfortunately, high rotation speed of the motor will inevitably result in an unpleasant noise. Moreover, larger the air inlet is, more spaces the fan unit will occupy, which conflicts with the tendency of miniaturization of a system casing in which the fan unit is received.

Therefore, it is desired to design a novel fan frame structure to overcome the aforementioned problems and increase the amount of air through the fan unit for promoting the heat dissipation thereof.

SUMMARY OF THE INVENTION

Accordingly, an object of the present invention is to provide a fan frame which has a plurality of grooves formed therein for providing extra air entrances to increase the amount of air through the fan unit thereof.

In order to achieve the object set out above, a fan frame for encircling an impeller of a fan unit in accordance with the present invention comprises a base and a plurality of sidewalls extending from the base. The base defines a hole in a center thereof The sidewalls extend upwardly and substantially from side edges of the base for encircling the impeller so that an air passage is formed between the impeller and the sidewalls. At least one of the sidewalls is bent inwardly to form a bent portion toward the hole of the base with a groove formed between the bent portion and an adjacent sidewall for providing access to airflow through the passage. The fan frame further comprises a motor mounting seat disposed in a center of the hole. A plurality of ribs connects the motor mounting seat to the base of the fan frame.

Other objects, advantages and novel features of the present invention will become more apparent from the following detailed description when taken in conjunction with the accompanying drawings, in which:

DETAILED DESCRIPTION OF THE INVENTION

Figure 1:
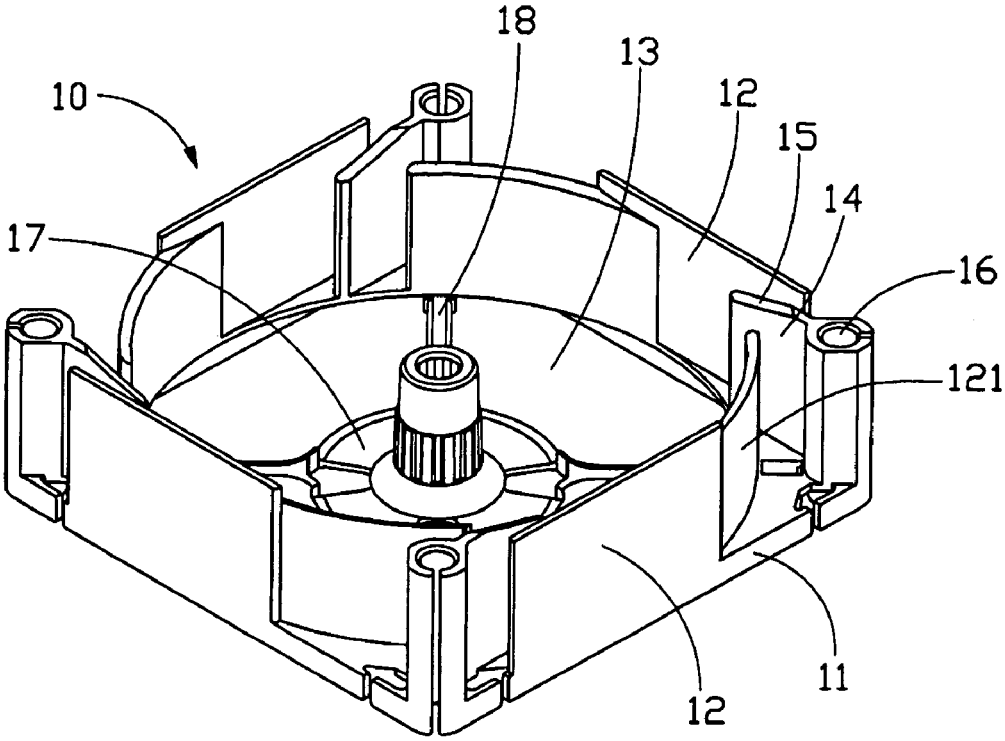
FIG. 1 is an isometric view of a fan frame in accordance with the present invention.

Reference will now be made to the drawing figures to describe the present invention in detail.

Figure 2:
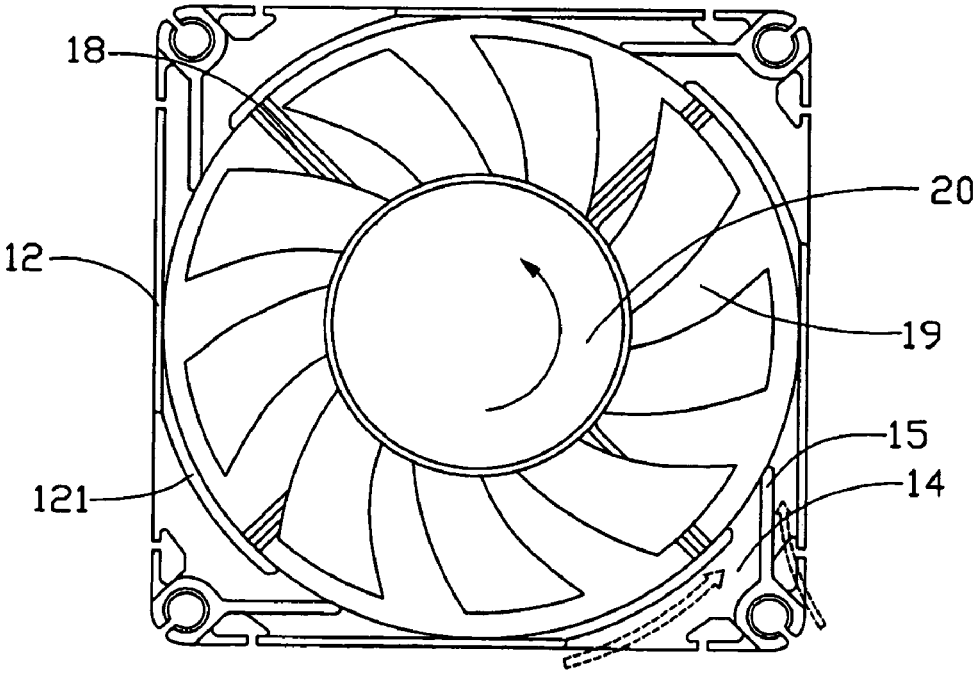
FIG. 2 is a top plan view of the fan frame of FIG. 1, with an impeller encircled therein.
Figure 3:
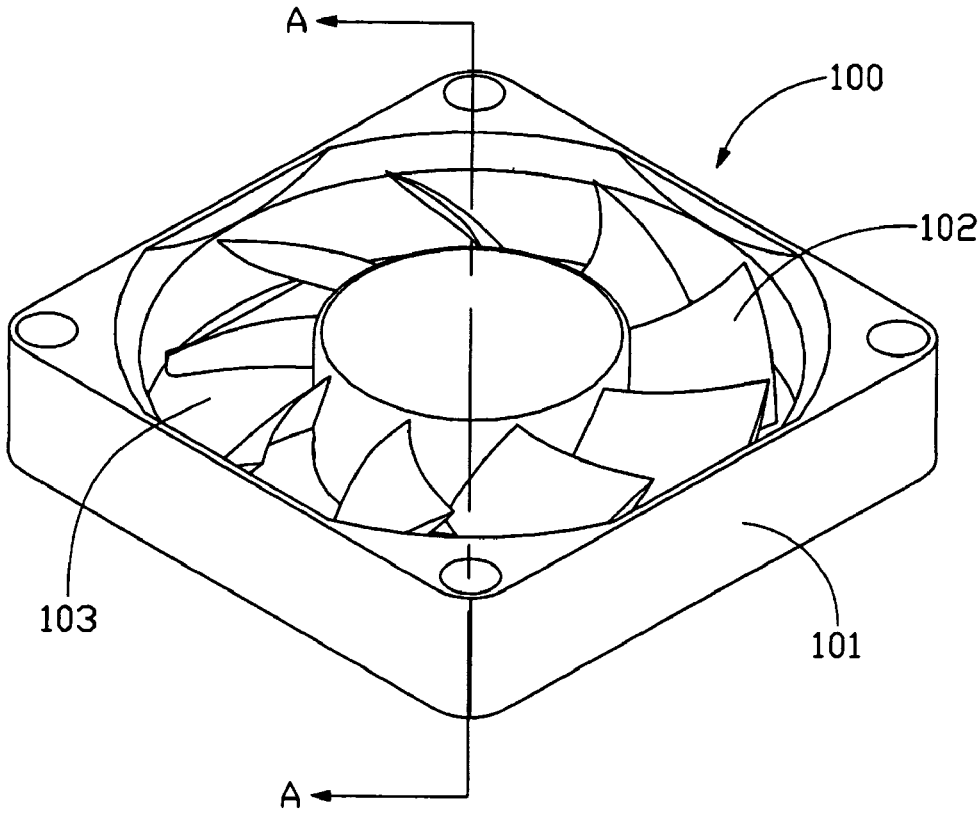
FIG. 3 (PRIOR ART)
FIG. 3 is an isometric view of a conventional fan unit for heat dissipation.
Figure 4:
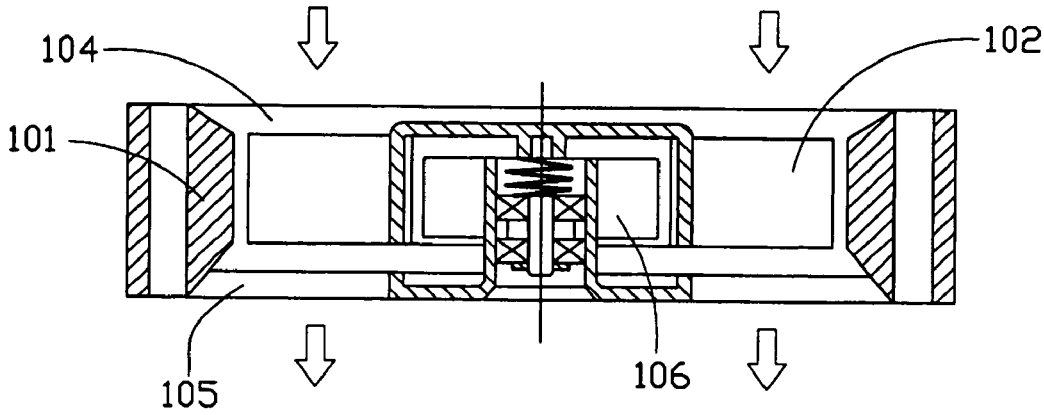
FIG. 4 (PRIOR ART)
FIG. 4 is a sectional view taken along line A—A of FIG. 3.

FIG. 1 and FIG. 2 show a fan frame 10 in accordance with present invention. The fan frame 10 comprises a base 11 and a plurality of sidewalls 12 extending form the base 11. The base 11 has a rectangular shape and defines a hole 13 in a center thereof for providing access to airflow. Each of the sidewalls 12 extends upwardly and substantially from a corresponding side edge of the base 11. Each of the sidewalls 12 forms a bent portion 121 being bent inwardly toward the hole 13 of the base 11 with an arc-shaped configuration, and a groove 14 is therefore formed between the bent portion 121 and an adjacent sidewall 12. The bent portions 121 of the sidewalls 12 are located at a concentric circle. The groove 14 is formed at a corner of the base 11 and spans a whole height of the sidewall 12. An impeller 20 is received in the frame 10 and encircled by the sidewalls 12. Selectively, one or more plates 15 can be interposed between the bent portion 121 and the adjacent sidewall 12 to thereby partition the groove 14 into parts. Four posts (not labeled) are formed at the corners of the base 11. The plates 15 extend from the corresponding posts. Each post defines a mounting hole 16 for mounting purposes.

The fan frame 10 of the present invention further comprises a motor mounting seat 17 disposed in a center of the hole 13 of the base 11. A plurality of ribs 18 connects the motor mounting seat 17 to the base 11. A motor (not visible) is mounted on the motor mounting seat 17 to drive the impeller 20 which is further mounted on the motor. Optionally, the fan frame 10, the ribs 18 and the motor mounting seat 17 can be integrally formed.

As illustrated in FIG. 2, the impeller 20 is located within the fan frame 10 to produce airflow during operation. An air passage 19 is formed between the impeller 20 and the sidewalls 12. The passage 19 comprises an air inlet at one end thereof and an air outlet at an opposite end thereof. The airflow derived from the impeller 20 flows into the fan unit from the air inlet. Simultaneously, the grooves 14 formed between the sidewalls 12 function as extra air entrances of the airflow. The airflow then collectively runs out of the fan unit through the air outlet for heat dissipation purposes.

In comparison with the prior art, the fan frame 10 of the present invention provides not only an axial-direction airflow passage 19, but also a plurality of radial-direction airflow passages via the grooves 14 formed between the sidewalls 12, thereby increasing the amount of air sucked into and through the fan unit.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fan frame for encircling an impeller of a fan unit, the fan frame comprising:

a base defining a hole therein for providing an airflow passage;

a plurality of sidewalls extending from substantial side edges of the base for encircling the impeller of the fan unit, at least one of the sidewalls forming one bent portion being bent inwardly toward the hole of the base with a groove formed between said portion and an adjacent sidewall for providing access to airflow through the passage;, wherein a plate is interposed between the bent portion and the adjacent sidewall to partition the groove into two parts.

2. The fan frame of claim 1, wherein the base has a rectangular shape.

3. The fan frame of claim 2, wherein the groove spans a whole height of said sidewall.

4. The fan frame of claim 3, wherein each of the sidewalls forms a bent portion located at a concentric circle with a groove formed between the bent portion and a corresponding adjacent sidewall.

5. The fan frame of claim 4, wherein the groove is formed at a corresponding corner of die base.

6. A fan frame for encircling an impeller of a fan unit the fan frame structure comprising:

a motor mounting seat for locating the impeller in the fan frame; and a plurality of sidewalls spaced from and disposed around the motor mounting seat for encircling the impeller of the fan unit, an air passage formed between the sidewalls and the impeller, the air passage defining an air inlet and an opposite air outlet;

wherein at least one of the sidewalls is bent inwardly to form a bent portion with a groove formed between said portion and an adjacent sidewall, and airflow produced by the impeller can flow into the fan unit by way of the air inlet and the groove and collectively run out of the fan unit through the air outlet thereby increasing the amount of air through the fan unit, wherein the groove spans a whole height of said sidewall.

7. The fan frame of claim 6, further comprising a base defining a hole in a center thereof, the motor mounting seat disposed in a center of the hole.

8. The fan frame of claim 7, wherein the sidewalls extend upwardly from side edges of the base for encircling the impeller.

9. The fan frame of claim 7, wherein the base has a rectangular shape and the groove is formed at a corner of the base.

10. The fan frame of claim 7, wherein a plurality of ribs is connected between the motor mounting seat and the base.

11. The fan frame of claim 6, wherein a plate is interposed between the bent portion and the adjacent sidewall to partition the groove into tow parts.

12. The fan frame of claim 6, wherein each of the sidewalls forms a bent portion located at a concentric circle.

13. A fan frame assembly comprising:

a base defining a hole therein for providing an airflow passage in a direction;

a fan unit located on the base and including an impeller rotatable about an axis in said direction;

a plurality of straight walls and a plurality of curved walls perpendicularly extending from the base and alternately surrounding said fan unit;

wherein said straight walls extend essentially along a contour of said fan unit while the curved walls extend essentially along a periphery of said impeller.

14. The fan frame assembly of claim 13, wherein said straight walls and said curved walls leave grooves to allow airflow to move in directions perpendicular to said direction.

15. The fan frame assembly of claim 14, wherein the grooves span a whole height of said straight walls and said curved walls.

16. The fan frame assembly of claim 14, wherein the curved walls locate at a concentric circle, and the grooves are formed at corners of the base.

17. The fan frame assembly of claim 13, wherein a plate is interposed between each curved wall and an adjacent straight wall to partition each of the grooves into two parts.

* * * * *